United States Patent [19]

Rombaut

[11] 4,314,238

[45] Feb. 2, 1982

[54] ELECTRIC LIGHTING INSTALLATION

[75] Inventor: Willy Rombaut, Ninove, Belgium

[73] Assignee: Gestinvest, Brussels, Belgium

[21] Appl. No.: 110,816

[22] Filed: Jan. 10, 1980

[30] Foreign Application Priority Data

Jan. 10, 1979 [BE] Belgium ..... 192823

[51] Int. Cl.[3] ..... G08B 25/00

[52] U.S. Cl. ..... 340/525; 340/80; 340/508; 340/524

[58] Field of Search ..... 340/52 R, 52 F, 80, 340/85, 641, 507, 508, 524, 525

[56] References Cited

U.S. PATENT DOCUMENTS 2,605,342 7/1952 Spurling ..... 340/525

FOREIGN PATENT DOCUMENTS 1032968 6/1966 United Kingdom .
1193966 6/1970 United Kingdom .
1473094 5/1977 United Kingdom .
1554213 10/1979 United Kingdom .

*Primary Examiner*—Alvin H. Waring
*Attorney, Agent, or Firm*—Scully, Scott, Murphy & Presser

[57] ABSTRACT

An electric lighting installation in which is provided at least one central control panel for each light point group, an auxiliary switch which is connected in a parallel circuit with the corresponding local switch, and for each light point or light point group, a corresponding indicator, such as an indicator lamp.

The lighting installation can be combined with an efficient alarm system.

21 Claims, 3 Drawing Figures

ELECTRIC LIGHTING INSTALLATION

This invention relates to an electric lighting installation for buildings with a supply circuit for light points a part of which at least are operated through a low-voltage circuit, which is provided in substantially every room of the concerned building, with local switches for the various light points.

The invention provides as a general object thereof a lighting installation which provides a complete survey over the switching conditions of the various light points, on the one hand, and to operate and control from said central location the various light points, on the other hand.

For this purpose, there is provided at least one central control panel with for each light point group, auxiliary switch which is connected in a parallel circuit with the corresponding local switch, and for each light point or light point group, a corresponding indicator, such as an indicator lamp.

In an advantageous embodiment of the invention, it is intended to provide a lighting installation which is combined with a very efficient alarm system.

Usefully for this purpose, the low-voltage circuit is provided in parallel ralationship with some local switches and the corresponding auxiliary switches on the central control panel, with an alarm circuit in which are arranged suitable sensing, monitoring or indicating components, such as break switches.

In a preferred embodiment of the lighting installation according to the invention, the low-voltage circuit is provided with parallel-connected diodes which allow on the one hand, to connect in a parallel connection at least the contacts from part of the pulse switches together and on the other hand, to connect such parallel-connected pulse switch contacts, in a series connection with an alarm switch in such a way that when the alarm switch is closed, the supply circuit operated by the low-voltage circuit is energized partly at least, according to the number of parallel-connected contacts from the pulse switches.

Advantageously, the alarm switch is also connected in series with a siren, bell or similar.

Other details and features of the invention will stand out from the following description given by way of non limitative example and with reference to the accompanying drawings, in which.

In the various figures the same reference numerals pertain to similar elements.

Figure 1:
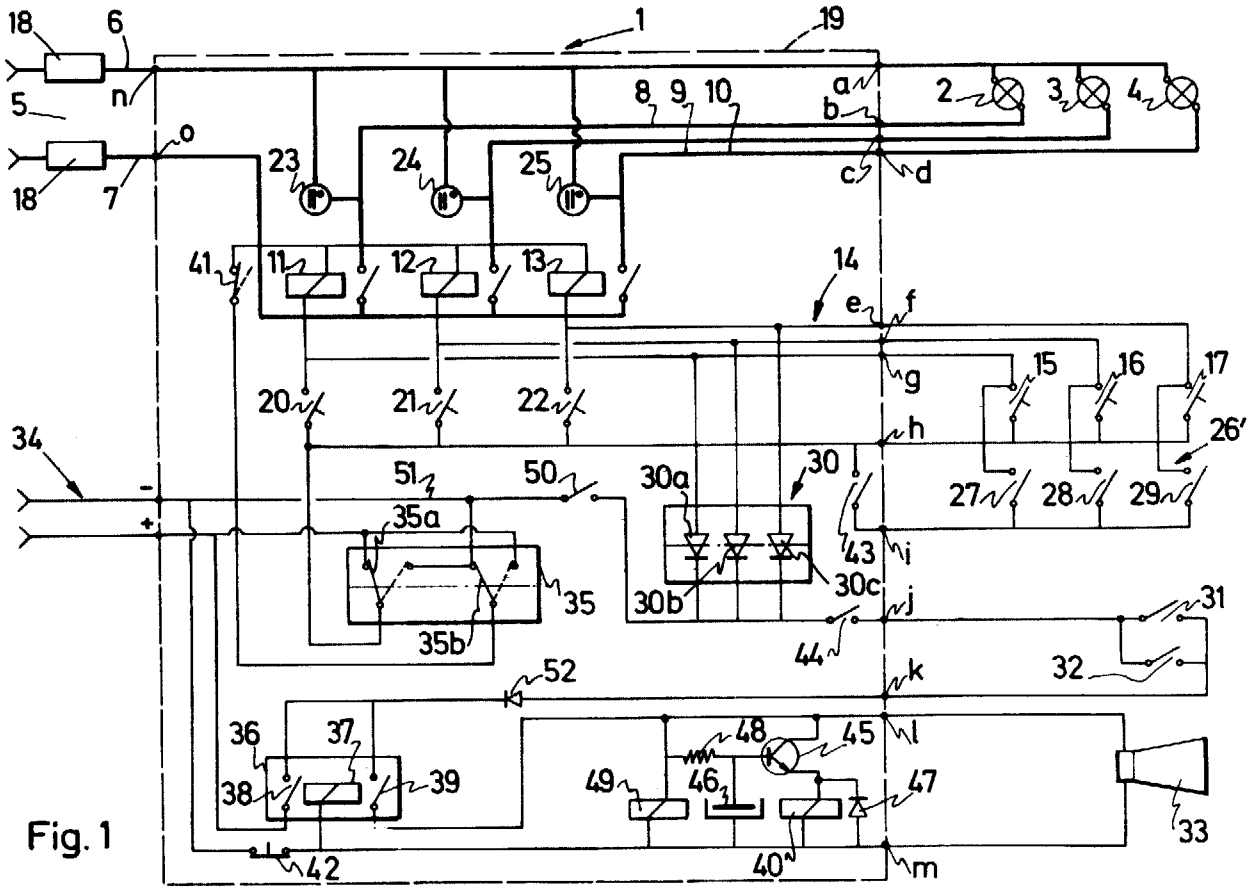
FIG. 1 is a circuit diagram from a particular embodiment of an electric lighting installation according to the invention.

In FIG. 1 has been shown a lighting installation which can possibly be used inside a home.

Said installation comprises a supply circuit 1 for light points 2, 3 and 4, which is connected in 5 to the usual mains, for example with 220 volts AC. Said supply circuit 1 is mainly comprised of a common line 6 for the various light points 2, 3 and 4, and a second common line 7 from which three discrete lines 8, 9 and 10 lead in parallel to the corresponding light points. Said circuit is for instance protected in the usual way through fuses 18, for example for a current of 6 amperes, which are generally found in the normal distributing box of an electric installation.

By means of electromagnetic pulse switches 11, 12 and 13, better known under the name "telebreakers", for each light point to be controlled, the supply circuit 1 is electromagnetically coupled to a low-voltage circuit 14 which is provided for every light point in the corresponding room from the home, with a local push-button switch 15, 16, 17 for operating said light points 2, 3 and 4.

Said low-voltage circuit 14 is supplied by means of a DC or battery circuit 34 which is continuously connected to the mains.

According to the invention, there is provided a central control panel which has been shown diagrammatically in FIG. 1 with a rectangle 19, in which an auxiliary switch is arranged for each light point or light point group, said auxiliary switches being connected in a parallel connection with the corresponding local push-button switches, and further for each light point or light point group is provided a pertaining indicator lamp.

In FIG. 1, said auxiliary switches are shown in 20, 21 and 22 while the corresponding indicator lamps are shown in 23, 24 and 25.

Said indicator lamps are connected in the supply circuit 1 in a parallel connection with the corresponding light points 2, 3 and 4 and thus light-up when the corresponding light point burns. By means of the switches 20, 21 and 22, said light points can be operated from the control panel 19.

Figure 2:
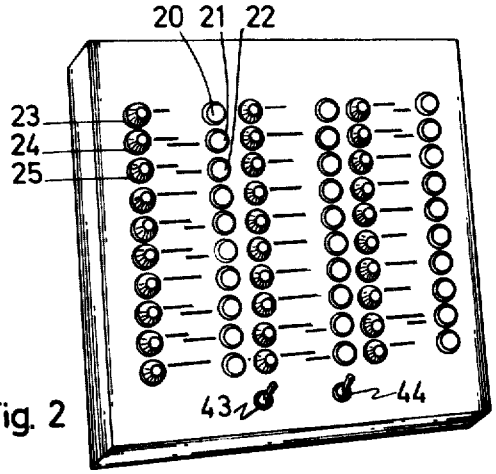
FIG. 2 is a front view from a control panel in a lighting installation according to the invention.

FIG. 2 shows a practical embodiment of such a control panel 19.

Said panel 19 thus comprises in a row the various indicator lamps and the corresponding auxiliary switches which are provided as push-button switches. Between a particular indicator lamp and the corresponding push-button is provided a space for the marking of the room where lies the light point or light point group to which pertain the concerned lamp and push-button. Consequently, an operator has a complete survey of the on and out light points in the complete house.

The electric lighting installation shown in FIG. 1 further comprises an alarm circuit which is shown diagrammatically in 26. Said alarm circuit 26 is part of the low-voltage circuit 14 and is provided with suitable sensing, monitoring and indicating components. In FIG. 1 said components are shown as break switches 27, 28 and 29 which are connected in parallel with the local switches 15, 16 and 17 and with the push-button switches 20, 21 and 22 from control panel 19. This thus results in the corresponding light point burning when one switch is closed among said switches 27, 28 or 29.

Means should of course be provided to let the inhabitants disable said break switches. For this purpose there has been provided in FIG. 1 a hand operated additional switch 43 in series connection with said break switches.

This part of the installation according to the invention can be named a frigthening installation as it allows when for example burglars enter the room through the windows, to switch the light on automatically, which has generally for result that the burglar runs away. At the same time the lighting of the lights is shown by the corresponding indicator lamp on the control panel 19, in such a way that when the inhabitants are home, they can directly determine that room where a possible break-in has been attempted. In the lighting installation according to the invention is further preferably included an alarm system proper which protects a building against breaking-in or similar, in the absence of the inhabitants for example.

In the control circuit 14 are provided therefore a number of parallel-connected diodes 30a, 30b, 30c which allow to connect all the desired light points in a parallel connection. Said diodes are then connected in series with a parallel switch 44 and an alarm switch 31, in such a way that by closing both switches 44 and 31, at least part of the light points will burn, depending on the number of pulse switches, so-called telebreakers, which are connected in parallel.

In the embodiment as shown in FIG. 1, all of the telebreakers 11 to 13 and consequently the corresponding light points 2, 3 and 4 are connected in parallel by said diodes 30a, 30b and 30c.

Said alarm switch is built-in advantageously in the door lock for the main entrance, in such a way that when locking-up said main entrance the alarm circuit is automatically energized, after having previously closed the parallel switch 44. A safety switch 32 can possibly be connected across the alarm switch 31, said switch 32 being arranged in a hiding-place and being for example operatable by means of the same key as the door lock.

The alarm switch 31 is further connected in series with a siren, bell or similar 33.

In the part of the control circuit for the siren, bell or similar 33 is provided a twin-contact alarm relay 36 the electromagnetic coil 37 of which acts on a first contact 38 in series connection between the alarm switch 31 and the siren, bell or similar 33, and on a second contact 39 in series connection between the battery and the electromagnetic coil 37.

There is further provided a time relay the time delay of which is about 0.2 seconds.

The electromagnetic coil 40, protected by a diode 47, from said time relay is connected in a parallel circuit relative to the siren, bell or similar 33 through a transistor 45 which is used as switch. For this purpose the transistor base is connected to a condensor 46 which when it is charged through a resistor 48, feeds to the base the required voltage to let an electric current flow from the collector, through the transistor emitter, to the coil. The charging time of the condenser is thus about 0.2 seconds to provide said time delay. When coil 40 is energized, it operates a contact from a circuit breaker 41 which is connected before the pulse switches 11, 12 and 13, in such a way that the current supply thereto is cut-off.

An inverting switch 35 is further provided in the supply line to the low-voltage circuit for changing the polarity of the voltage across the electromagnetic coils of the pulse switches 11, 12 and 13, and across the diodes 30a, 30b, 30c. Said inverting switch is controlled from an electromagnetic inverting coil 49, which thus brings as it is energized, both contacts 35a and 35b to another position. Said coil 49 further acts on an additional switch 50 which lies in a series connection between the negative pole of the DC source 34 and diodes 30a, 30b and 30c, in a common connecting line 51 thereof to said negative pole.

An isolating diode 52 is further connected in series between alarm switch 31 and electromagnetic coil 37 from said alarm relay 36.

Finally an alarm cut-off switch 42 is provided in a concealed location, said switch 42 lying in a series connection with the siren, bell or similar 33.

The adjustment and operation of the above-described lighting installation occurs as follows.

The lighting installation shown in the figures can be brought to three different conditions, namely one condition with completely cut-off alarm system; one condition with partly cut-in alarm system and one condition with completely cut-in alarm system.

In the first condition with completely cut-off alarm system, the common line for the push-button switches 15, 16 and 17 is connected to the positive pole of battery 34 while the negative pole is connected to the common line for the pulse switches 11, 12 and 13. When a local switch 15, 16 or 17 or a switch 20, 21 or 22 on control panel 19 is closed, the corresponding coil from the pulse switch is energized and only that light will burn the switch of which is closed, together with the corresponding indicator lamp on the control panel.

In the second condition with partly cut-in alarm, the switch 43 is closed. This results in the break switches 27, 28 and 29 being connected across the push-button switches 15, 16 and 17 in such a way that when one such break switch is closed for example by the opening of a window, a particular light with the corresponding indicator lamp will also light in a way similar to the first condition as described above.

In the third condition with completely cut-in alarm system, the parallel switch 44, the alarm switch 31 and the safety switch 32 are closed.

In this way the light points 2, 3 and 4 are connected in parallel and by the closing of the main entrance, the alarm circuit is completed and thus the alarm system is cut-in.

When in any way whatsoever a contact is closed, the electric current is coupled from the positive battery pole through but one diode 30a, 30b or 30c depending on the closed contact, through the alarm switch 39, the isolation diode 52 to the coil 37 from relay 36 which closes switches 38 and 39. This results in starting the siren 33 and as contact 38 bridges coil 37, the siren and the relay 36 are thus connected directly to the battery, in such a way that the circuit to the siren can no more be cut-off. Due to the closing of switch 39 the inverting coil 49 is also energized and by means of switch 35, the voltage to the pulse switches 11, 12 and 13 and to the push-button switches 15, 16 and 17 is reversed in polarity. Consequently to the common line of the pulse switches is coupled a positive voltage. Simultaneously by means of coil 49, switch 50 is closed whereby thus a negative voltage is coupled through the parallel-connected diodes 30a, 30b and 30c which are now conducting, to the other pole of the pulse switches 11, 12 and 13. This results in all of the light points the control circuit of which comprises a diode 30a, 30b or 30c, burning. Generally it is insured that at least one such light point is present in every room.

Directly afterwards, after about 0.2 seconds, the coil 40 is energized and the contact 41 cuts-off the supply to the pulse switches 11, 12 and 13, in such a way that said switches do not further conduct undesirably and moreover they can no more be cut-out and consequently they retain the supply circuit to the light points 2, 3 and 4 closed. To return the lighting installation to the normal condition thereof, the concealed alarm cut-off switch 42 has to be operated and the parallel switch should be returned to the normal open condition thereof.

As it appears from the above, there is thus provided a very simple and efficient alarm system with the highest reliability; vibrations, light flashes and similar cannot cause by themselves the alarm system to be triggered for example. Moreover this is a very flexible system which makes possible any kind of combination depending on a specific case of protection required. This system is thus not a so-called prefabricated system but rather a safety which allows all possible variations in such a way that it cannot practically also be fathomed by uninitiated persons.

This invention thus allows by adding a limited number of components to a lighting installation known per se, to obtain a completely protected alarm system without increasing substantially the costs of such a lighting installation. This is mainly due to the lighting installation itself being cut-in in the alarm system and thus being considered as an essential part thereof.

Figure 3:
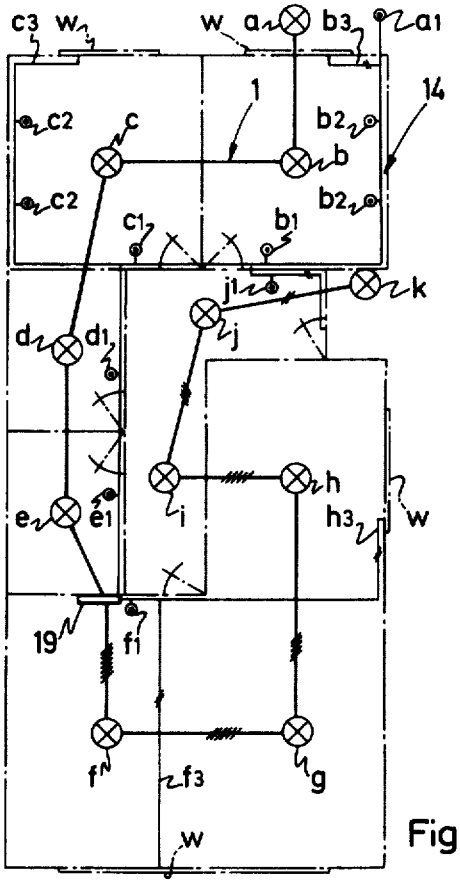
FIG. 3 is a diagrammatic showing of the wiring of an electric lighting installation according to the invention.

In FIG. 3 is shown a practical embodiment of the electric lighting installation wiring according to the invention, for a simple house.

A total of ten light points a, b, c, d, e, f, g, h, i, j are provided in this case, said light points being supplied by circuit 1 controlled by the low-voltage circuit 14 in which are provided the corresponding switches $a_1$, $b_1$, $c_1$ etc. for the switching on and out of the corresponding light points. Beside said switches some local plugs, for example $c_2$, $b_2$, can be provided, said plugs being also cut-in in the low-voltage control circuit 14 being impossible to distinguish from the usual wall plugs. It is consequently possible to arrange in any location some sensor or similar. From said wall plugs or switches can further lead lines $a_3$, $b_3$, $c_3$ etc. to break switches not shown, which can be located in various ways. Said switches may for example be so provided that by the opening of a window, door or shutter, a contact is closed which causes the light point in the room concerned to burn. Said break switches can be brought to a locked-out condition when they should not be energized. Said lines with the concerned switches are thus part of the abovedescribed alarm circuit.

In a particular embodiment of the invention, use is made for the designing of the electric lighting installation according to the invention, of a very complete central control panel 19 on which substantially all the components are arranged with the desired connections.

As shown in dotted lines in FIG. 1 and as shown also in FIG. 2, the control panel front side is provided according to the invention (see FIG. 2) for each light point 2, 3, 4 or light point group with a push-button 20, 21, 22, next to each push-button with an indicator lamp, and with switches 43 and 44 for the alarm circuit. On the back side of the panel are fastened the required pulse switches 11, 12, 13, diodes 30*a*, 30*b*, 30*c*, 52, inverting switch 35 and the various relays 36, 40, 49 with the corresponding contacts, said components being suitably connected together.

There are further provided also on the back side, the various connections for the supply source 5 (mains voltage) of the lighting circuit for the light points 2, 3, 4 connected in said circuit, for the corresponding local push-button switches 15, 16, 17, for the alarm switch 31 and safety switch 32, and for the siren 33. Said connections are shown diagrammatically in a, b, c, d, e, f, g, h, . . . m, n, o.

Said panel can for example form the cover of the completely protected box wherein all said components are mounted as described above.

It must be understood that the invention is not limited to the above embodiments and that many changes can be brought therein without departing from the scope of the invention as defined by the appended claims.

For instance the alarm system could be limited to the energizing of the light points and the siren could for example be replaced by a swinging light or similar.

What I claim is:

1. Electric lighting installation for buildings with a supply circuit for light points a part of which at least are operated through a low-voltage circuit, which is provided in substantially every room of the concerned building, with local switches for the various light points, in which there is provided at least one central control panel with for each light point or light point group, an auxiliary switch which is connected in a parallel circuit with the corresponding local switch, and for each light point or light point group, a corresponding indicator, such as an indicator lamp.

2. Electric light installation as defined in claim 1, in which the indicator in the supply circuit is connected across the corresponding light point or light point group.

3. Electric lighting installation as defined in claim 2, in which the indicator lamp is comprised of a neon lamp.

4. Electric lighting installation as defined in claim 1, in which the low-voltage circuit is coupled electromagnetically to the supply circuit through pulse switches.

5. Electric lighting installation as defined in claim 1, in which the low-voltage circuit, in a parallel connection with some local switches and the corresponding auxiliary switches, is provided with an alarm circuit wherein suitable sensing or indicating components such as break switches, are provided.

6. Electric lighting installation for a building with a supply circuit for light points a part of which at least are operated through a low-voltage circuit coupled by electromagnetic means to the supply circuit through pulse switches, said low-voltage circuit comprising, in at least one room of the building, local switches for the various light points, means which allow, on the one hand, to connect in a parallel connection at least the contacts from a part of the pulse switches together and, on the other hand, to connect such parallel connected pulse switch contacts, in a series connection with an alarm switch in such a way that when the alarm switch is closed, and at least one of the light points is switched on by cutting in any contact, the supply circuit is energized partly at least, according to the number of parallel connected contacts from the pulse switches.

7. Electric lighting installation as defined in claim 6, in which the alarm switch is also connected in series with a siren, bell or similar.

8. Electric lighting installation switch as defined in claim 6, in which a common parallel switch is provided in series connection with said diodes and alarm switch.

9. Electric lighting installation as defined in claim 6, in which the low-voltage circuit is powered from batteries connected to the supply circuit.

10. Electric lighting installation as defined in claim 6, in which an alarm relay is provided with an electromagnetic coil in parallel connection relative to said siren, bell or similar, said coil acting on a first contact in series connection between said alarm switch and said siren, bell or similar, and on a second contact in series connection between said electromagnetic coil and the supply for the low-voltage circuit.

11. Electric lighting installation as defined in claim 7, in which the electromagnetic coil from a time relay is connected in parallel relative to said siren, bell or similar, said relay having a cut-out switch on which said coil acts, said switch being connected before said pulse switches and cutting-off the current supply thereto when said time relay coil is energized.

12. Electric lighting installation as defined in claim 11, in which said time relay has a time delay of about 0.2 seconds.

13. Electric lighting installation as defined in claim 6, in which an inverting switch is provided in the supply to the low-voltage circuit, which is a DC circuit, to change de polarity of the voltage across the pulse switch electromagnetic coils and across the diodes, whereby said inverting switch is controlled from an inverting electromagnetic coil connected across said siren, bell or similar.

14. Electric lighting installation as defined in claim 10, in which an isolating diode is connected in series between said alarm switch and said alarm relay electromagnetic coil.

15. Electric lighting installation as defined in claim 6, in which said alarm switch is built-in in an outer door lock.

16. Electric lighting installation according to claim 6, in which a safety switch is connected across said alarm switch.

17. Electric lighting installation as defined in claim 6, in which an alarm cut-out switch is provided in series connection with said siren, bell or similar.

18. Control panel for an electric lighting installation as defined in claim 6, which comprises on the one hand, on the first side, for each light point or light point group, a switch, next to each switch a corresponding indicator such as an indicator lamp, and operating switches for an alarm circuit and, on the other hand, on the said control panel's back side, the pulse switches, and the means to connect at least the contacts from a part of the pulse switches in a parallel connection and in a series connection with an alarm switch.

19. Electric lighting installation for buildings with a supply circuit for light points a part of which at least are operated through a low-voltage circuit, which is provided in substantially every room of the concerned building, with local switches for the various light points, in which there is provided at least one central control panel with for each light point or light point group, an auxiliary switch which is connected in a parallel circuit with the corresponding local switch, with a corresponding indicator for each light point or light point group and with sensing, monitoring or indicating components, located in such room and cutting-in the circuit of the corresponding light point when being actuated, means being provided to disable said components.

20. Electric lighting installation according to claim 19, in which said components are break switches which are connected in parallel with the local switches and the auxiliary switches from the control panel, and the means for disabling said break switches are formed by an additional switch in series connection with said break switches.

21. Electric lighting installation according to claim 6, wherein said means which allow comprise parallel-connected diodes.

* * * * *